US006563370B2

(12) United States Patent
Coady

(10) Patent No.: US 6,563,370 B2
(45) Date of Patent: May 13, 2003

(54) CURVATURE-CORRECTED BAND-GAP VOLTAGE REFERENCE CIRCUIT

(75) Inventor: Edmond Patrick Coady, Colorado Springs, CO (US)

(73) Assignee: Maxim Integrated Products, Inc., Sunnyvale, CA (US)

( * ) Notice: Subject to any disclaimer, the term of this patent is extended or adjusted under 35 U.S.C. 154(b) by 0 days.

(21) Appl. No.: 09/894,850

(22) Filed: Jun. 28, 2001

(65) Prior Publication Data

US 2003/0006831 A1 Jan. 9, 2003

(51) Int. Cl.[7] ..... G05F 1/10
(52) U.S. Cl. ..... 327/539; 323/313
(58) Field of Search ..... 327/539, 540, 327/545; 323/313

(56) References Cited

U.S. PATENT DOCUMENTS 4,250,445 A * 2/1981 Brokaw ..... 323/313
4,263,519 A * 4/1981 Schade, Jr. ..... 327/540
4,317,054 A * 2/1982 Caruso et al. ..... 327/540
5,229,710 A * 7/1993 Kraus et al. ..... 323/313
5,291,122 A * 3/1994 Sudy ..... 323/313
6,075,407 A * 6/2000 Doyle ..... 327/539

* cited by examiner

*Primary Examiner*—Terry D. Cunningham
(74) *Attorney, Agent, or Firm*—Blakely, Sokoloff, Taylor & Zafman LLP

(57) ABSTRACT

This band-gap circuit overcomes the deficiencies of conventional band-gap circuits by compensating for higher order temperature effects, thereby increasing accuracy. A first resistor network including two resistors is connect to a first transistor while a second resistor network that includes one resistor is connected to a second transistor. One resistor in the first resistor network has a high temperature sensitivity, and therefore produces a temperature dependent ratio of currents through the transistors. The inverting input and noninverting input of an operational amplifier are coupled to the collectors of the two transistors. The emitter region of the second transistor is coupled to two additional resistors which are connected in series to each other. The emitter region of the first transistor is coupled to the junction between these two additional resistors. The output of the operational amplifier is coupled to the bases of the transistors. Introducing a temperature dependent current ratio through the transistors allows for correction of higher order temperature terms previously ignored by prior art band-gap circuits.

12 Claims, 2 Drawing Sheets

CURVATURE-CORRECTED BAND-GAP VOLTAGE REFERENCE CIRCUIT

CROSS-REFERENCE TO RELATED APPLICATIONS

Not applicable.

STATEMENT REGARDING FEDERALLY SPONSORED RESEARCH

Not applicable.

FIELD OF THE INVENTION

The instant invention relates to band-gap voltage reference circuits, and specifically to the class of band-gap circuits which provide a higher degree of temperature stability by correcting for higher order linearity terms.

BACKGROUND OF INVENTION

Band-gap voltage reference circuits provide an output voltage that remains substantially constant over a wide temperature range. These reference circuits operate using the principle of adding a first voltage with a positive temperature coefficient to a second voltage with an equal but opposite negative temperature coefficient. The positive temperature coefficient voltage is extracted from a bipolar transistor in the form of the thermal voltage, kT/q (V.sub.T), where k is Boltzman's constant, T is absolute temperature in degrees Kelvin, and q is the charge of an electron. The negative temperature coefficient voltage is extracted from the base-emitter voltage (V.sub.BE) of a forward-biased bipolar transistor. The band-gap voltage, which is insensitive to changes in temperature, is realized by adding the positive and negative temperature coefficient voltages in proper proportions.

A conventional prior art band-gap circuit is shown in FIG. 1. In prior art circuits such as this, all the resistors are manufactured similarly, so the ratio of R3 20 to R4 30 would remain constant with respect to temperature. An operational amplifier 10 maintains an equal voltage across R3 20 and R4 30, thereby keeping the ratios of currents (IC1 to IC2) into the collectors of Q1 40 and Q2 50 equal over temperature also. It can be seen that IC1 is inversely proportional to R3 and current IC2 is inversely proportional to R4 30. The emitter areas of transistors Q1 40 and Q2 50 are in a ratio of A to nA with the emitter area of Q2 50 scaled larger than that of Q1 40 by a factor of n. The resulting collector currents and base to emitter voltages of the two transistors result in a voltage across R1 that equals kT/qln(n×IC1/IC2), where ln is the natural logarithm function and n is the factor by which the emitter area of Q2 50 is scaled larger than that of Q1 40. The voltage across R1 is amplified across R2 by the factor of 2×R2/R1.

The band-gap circuit functions by taking output voltages that are positively and negatively changing with respect to temperature, and adding them to obtain a substantially constant output voltage with respect to temperature. Specifically, the base to emitter voltage, V.sub.BE of Q1 40 has a negative temperature coefficient, while the voltage across R2 has a positive temperature coefficient. By taking the output voltage of the circuit at the base of Q1 40, the positive and negative temperature coefficients essentially cancel, so the output voltage remains constant with respect to temperature.

A first-order analysis of a band-gap reference circuit approximates the positive and negative temperature coefficient voltages to be exact linear functions of temperature. The positive temperature coefficient voltage generated from V.sub.T is in fact substantially linear with respect to temperature. The generated negative temperature coefficient voltage from the V.sub.BE of a bipolar transistor contains higher order non-linear terms that have been found to be approximated by the function Tln(T), where ln(T) is the natural logarithm function of absolute temperature. When the band-gap voltage is generated using conventional circuit techniques, the Tln(T) term remains and is considered an error term which compromises the accuracy of the reference output voltage.

What is needed is a more accurate band-gap reference circuit that corrects for errors resulting from temperature changes that lead to errors in the reference voltage.

SUMMARY OF INVENTION

The present invention solves the above-referenced problems. It is an object of the present invention to improve the accuracy of band-gap voltage reference circuits with variations in ambient temperature. Conventional band-gap circuits exhibit a variation in output voltage when ambient temperature changes. Conventional band-gap output voltages will exhibit a parabolic characteristic when plotted versus temperature on a graph. The present invention reduces the magnitude of this voltage error by adding an equal but opposite parabolic term to the voltage reference to cancel the second order temperature drift term inherently found in conventional band-gap circuitry.

In accordance with the present invention, a resistor that has a high temperature coefficient is added to the collector of a transistor.

BRIEF DESCRIPTION OF DRAWINGS

These and other objects, features, and characteristics of the present invention will become apparent to one skilled in the art from a close study of the following detailed description in conjunction with the accompanying drawings and appended claims, all of which form a part of this application. In the drawings:

DETAILED DESCRIPTION OF THE PRESENTLY PREFERRED EXEMPLARY EMBODIMENTS

The band-gap reference circuit of the present invention, as described with reference to FIG. 2, compensates for the Tln(T) variation found in conventional implementations of band-gap circuits. In the following description, various aspects of the present invention will be depicted. However, it will be apparent to those skilled in the art that the present invention may be practiced with only some or all aspects of the present invention. For purposes of explanation, specific configurations are set forth in order to provide a thorough understanding of the present invention. However, it will also be apparent to one skilled in the art that the present invention may be practiced without the specific details. In other instances, well known features are omitted or simplified such that the present invention is not unnecessarily obscured.

This invention comprises a source voltage VCC, resistors R1 120, R2 130, R3 140, R4 150, and R5 160, transistors Q1 170 and Q2 180 and one operational amplifier A1 190. A prior art band-gap reference circuit with no compensation for Tln(T) will be referred to with reference to FIG. 1.

Figure 2:
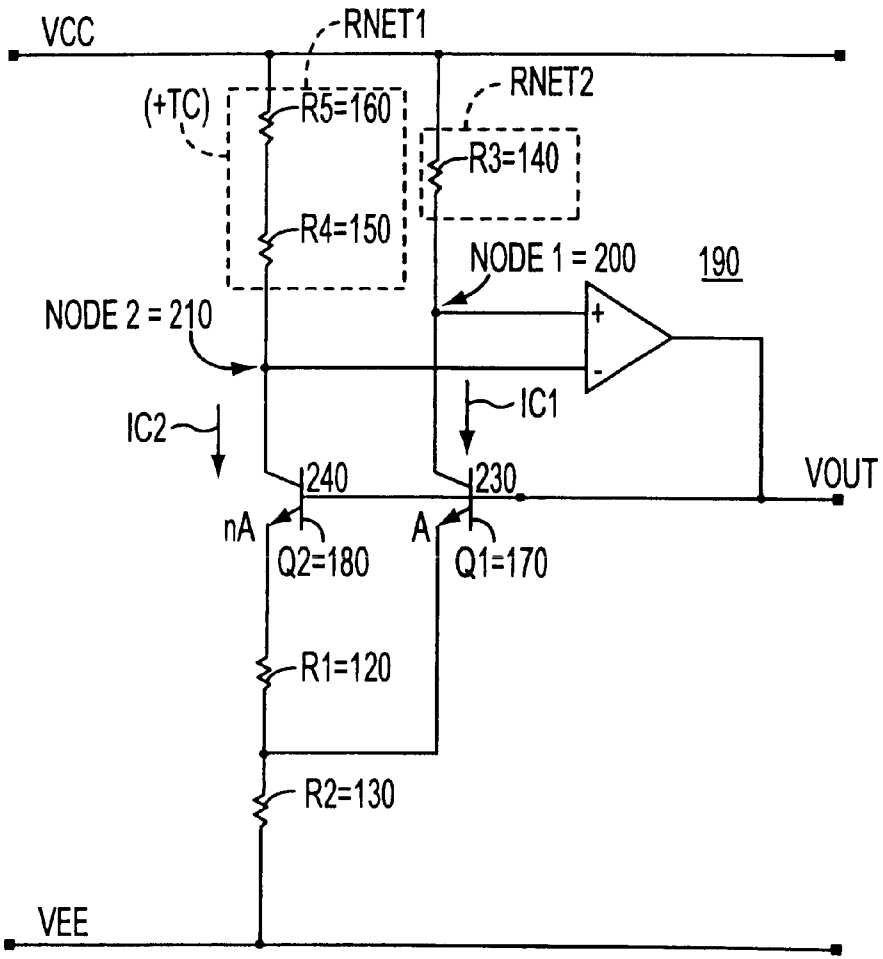
FIG. 2 shows the band-gap circuit of the instant invention.

In accordance with the present invention as described in FIG. 2, resistors R4 150 and R5 160 form a first resistor network (RNET 1) that is connected in series and provide a current IC2 into the collector of Q2 180. Similarly, resistor R3 140 may be considered as a second resistor network that is connected in series with the collector of Q1 170 and will draw a current IC1 from VCC into the collector of Q1 170. Various circuit techniques may be used to equalize the voltage across the first and second resistor networks. One such technique is to connect the non-inverting and inverting inputs of operational amplifier A1 190 to node 1 shown at 200 and node 2 shown at 210, respectively, and to connect the output of the operational amplifier to the bases in 230, 240 respectively of Q1 at 170 and Q2 at 180. The ratio of the collector current of Q1 170 to the collector current of Q2 180 is determined solely by the ratio of the resistance value of first resistor network (RNET 1) to the second resistor network RNET2.

Prior art band-gap circuits have maintained a specifically constant ratio between the collector currents of Q1 and Q2. Referring back to FIG. 1, the prior art circuit uses identical geometry resistors manufactured using the same process step to maintain a constant ratio of R3 20 to R4 30 with variations in temperature. It is known when a constant current-density ratio greater than unity is maintained between Q1 40 and Q2 50 that a voltage proportional to absolute temperature voltage is developed between the emitters of Q1 40 and Q2 50. The current density ratio of Q1 40 to Q2 50 is determined by resistor values R3 20 and R4 30 and emitter area ratio of Q2 50 to Q1 40, denoted as n in FIG. 1.

$$\Delta V_{R1} = \frac{kT}{q}\ln\left(n\cdot\frac{R4}{R3}\right) \tag{1}$$

Figure 1:
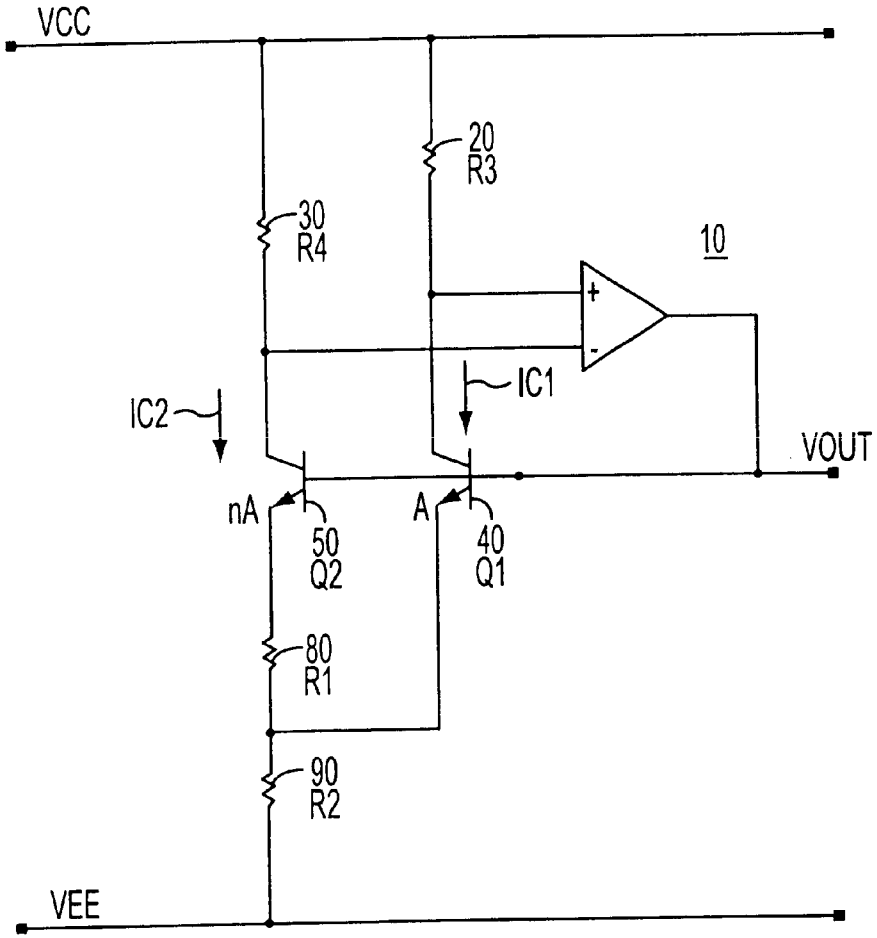
FIG. 1 (PRIOR ART)
FIG. 1 shows a conventional PRIOR ART band-gap circuit.

Equation (1), where k is Boltzmann's constant, q is the charge of an electron, T is absolute temperature in Kelvin, and R3 20, R4 30 and n are as denoted in FIG. 1, shows that a voltage proportional to temperature voltage is developed across R1 80. The voltage across R1 80 is amplified by (1+R4/R3)×(R2/R1) and added to the base-emitter voltage of Q1 40 to create the band-gap voltage.

Referring back to FIG. 2, the present invention purposely introduces temperature dependence to the ratio of resistor networks RNET1 and RNET2. This is a substantial departure from the architecture of prior art band-gap circuits. Resistor R3 140 and R4 150 are preferably thin film resistors with a low temperature coefficient of resistance (TCR). Resistor R5 160 is built in such a way as to have a high TCR comparatively to R3 140 and R4 150. In practice, various materials, such as a diffused resistor, can be used to build R5 160 to realize a high value of TCR.

$$\Delta V_{R1} = \frac{kT}{q}\cdot\ln\left[n\cdot\left(\frac{R_4 + R_5(T - T_0)\cdot TC_{R5}}{R_3}\right)\right] \tag{2}$$

From equation (2), it is apparent that the circuit arrangement in the present invention introduces an additional term that is equal to aTln(b+T), where a and b are constant terms determined by the values R3 140, R4 150 and R5 160, the temperature coefficient of R5 160 and the emitter area ratio of transistor Q2 180 to transistor Q1 170, denoted n. ΔVR1 is then amplified by (1+RNET1/RNET2)×(R2/R1). By proper selection of these circuit component values, the term aTln(b+T), can be set to approximate the Tln(T) term that is arises in the base-emitter voltage expression of Q1 170. With the addition of the Tln(T) term, the output voltage at operational amplifier 190 is substantially constant with respect to variations in temperature. The output of the amplifier 190 is coupled in a feedback loop to develop a feedback signal corresponding to the output signal. Therefore, although circuit analysis is much more difficult with the introduction of a temperature dependent current ratio into the pair of transistors, this allows for correction of higher order terms previously ignored in prior art band-gap circuits. It is noted that disclosed is merely one method of creating a temperature dependent current ratio, those skilled in the art may be able to produce other such means to accomplish this. For example only one particular method is disclosed for producing a temperature dependent current ratio through the transistors. This temperature dependent ratio may also be produced by introducing any type of temperature variations between the first and second resistor networks. If the first resistor network has a high temperature dependence the second resistor network may have a substantial temperature dependence also but different in magnitude from the first resistor networks.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds, are therefore intended to be embraced by the appended claims.

What is claimed is:

1. A band-gap voltage reference circuit comprising:

a pair of transistors including a first transistor and a second transistor each having base, collector and emitter electrodes, wherein the emitter electrodes of said transistors are connected with a third resistor network;

a first resistor network connected to a collector electrode of the first transistor, wherein said first resistor network includes a first resistor that has a first temperature coefficient, and a second resistor that has a second temperature coefficient, wherein said first temperature coefficient is greater than said second temperature coefficient;

a second resistor network connected to a collector electrode of the second transistor;

an amplifier device for producing an output signal responsive to the difference between the voltages across said pair of resistor networks and having an output terminal coupled with said base electrodes of said pair of transistors; and wherein said amplifier device provides an output voltage that is temperature compensated.

2. Apparatus as in claim 1, wherein the second resistor of said first resistor network is connected in series to the first resistor of said first resistor network.

3. Apparatus as in claim 2, wherein a ratio of current densities in the first and second transistors changes as a function of temperature.

4. Apparatus as in claim 3, wherein said second resistor network includes a third resistor that has a third temperature coefficient connected with said second transistor collector, wherein said third temperature coefficient is less than said first temperature coefficeint.

5. Apparatus as in claim 1, wherein said third resistor network comprises a fourth resistor connected with the emitter electrodes of said first and second transistor.

6. Apparatus as in claim 5, wherein said third resistor network comprises a fifth resistor connected in series with the emitter electrode of said second transistor.

7. Apparatus as in claim 6, wherein said second, third, fourth and fifth resistors each have a temperature coefficient less than said first temperature coefficient.

8. Apparatus as in claim 7, wherein said temperature dependent current density ratio between said first and second transistors operates to reduce higher order terms of temperature coefficients in a band-gap reference.

9. A band-gap voltage reference circuit comprising:

a first and second transistor each having a base, collector and emitter electrodes; wherein the base electrodes of the first and second transistor are connected together;

a first network electrically connected with the emitter electrodes of said first and second transistors;

a differential current density device for producing different current densities in said first and second transistors, wherein a ratio of the current densities is temperature dependent; wherein said differential current density device comprises a first resistor network connected to a collector of the first transistor, wherein said first resistor network includes a first resistor in series with said collector, wherein the first resistor in said first resistor network has a first temperature coefficient and a second resistor with a second temperature coefficient less than said first temperature coefficient;

an amplifier device for producing an output supplied to the base electrodes responsive to said differential current density device; and an output terminal of said amplifier device, wherein said output terminal develops a substantially temperature independent voltage.

10. Apparatus as in claim 9, wherein the current density device further comprises a second resistor network connected to the collector of the second transistor.

11. Apparatus as in claim 10, wherein said second resistor network includes a resistor that has a third temperature coefficient less than said first temperature coefficient.

12. Apparatus as in claim 11, wherein the temperature dependent current density ratio between said first and second transistors operates to reduce higher order terms of temperature coefficients in a band-gap reference.

* * * * *